US006206367B1

(12) United States Patent
Jo

(10) Patent No.: US 6,206,367 B1
(45) Date of Patent: Mar. 27, 2001

(54) AUTOMATIC SHEET FEEDER FOR INK JET PRINTER

(75) Inventor: Yong-Kon Jo, Kyongsangbuk-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/204,086

(22) Filed: Dec. 3, 1998

(30) Foreign Application Priority Data

Dec. 3, 1997 (KR) ..... 97-35496

(51) Int. Cl.[7] ..... B65H 5/00

(52) U.S. Cl. ..... 271/264; 271/3.08; 271/3.02; 271/226; 271/248; 271/253

(58) Field of Search ..... 271/3.01, 8.01, 271/13, 226, 241, 248, 250, 253, 264, 275; 101/410

(56) References Cited

U.S. PATENT DOCUMENTS

| | | | |
|---|---|---|---|
| 2,204,715 | 6/1940 | Wimmer | 271/39 |
| 2,679,801 | 6/1954 | Ford et al. | 101/132.5 |
| 3,599,971 | 8/1971 | Morioka | 271/36 |
| 4,511,135 * | 4/1985 | Huerta et al. | 271/126 |
| 5,377,970 | 1/1995 | Kikuchi | 271/121 |
| 5,485,991 | 1/1996 | Hirano et al. | 271/121 |
| 5,527,026 * | 6/1996 | Padget et al. | 271/21 |
| 5,697,716 * | 12/1997 | Akahane | 400/624 |

OTHER PUBLICATIONS

Photostat—Brother M1809 Dot Matrix Printer Sheet Feeder.*

* cited by examiner

*Primary Examiner*—Donald P. Walsh
*Assistant Examiner*—Mark J. Beauchaine
(74) *Attorney, Agent, or Firm*—Robert E. Bushnell, Esq.

(57) ABSTRACT

An automatic sheet feeder for an ink jet printer is disclosed. The automatic sheet feeder includes a sheet support fixed to a frame. A shaft is rotatably secured to an upper portion of the sheet support, and rotates in a specified direction by a driving force from a driver. A sheet width adjusting guide is movably mounted on one side of the shaft such that a front end is movable along the shaft and a rear end is slidable keeping in contact with the sheet support. At least one feeding roller assembly is rotatably mounted on another side of the shaft, and includes a feeding roller for feeding a sheet by a rotation force of the shaft. The shaft rotates in such a direction that the feeding roller contacts the sheet, and the feeding roller rotates in an opposite direction of the shaft.

3 Claims, 2 Drawing Sheets

AUTOMATIC SHEET FEEDER FOR INK JET PRINTER

CLAIM OF PRIORITY

This application makes reference to, incorporates the same herein, and claims all benefits accruing under 35 U.S.C. §119 from an application for AUTOMATIC SHEET FEEDER FOR INK JET PRINTER earlier filed in the Korean Industrial Property Office on the Dec. 3, 1997 and there duly assigned Ser. No. 35496/1997.

BACKGROUND OF THE INVENTION

1. Field of the Invention

The present invention relates to the class of devices for sheet feeding, and in particular, to an automatic sheet feeder (ASF) for an ink jet printer.

2. Description of the Related Art

Ink jet printers, which are common peripheral devices for computers, are very popular due to the ease of replacing a disposable ink cartridge as well as for the cheapness and compactness of these devices. The disposable ink cartridge which is detachable from a carriage in an ink jet printer is filled with ink and has a print head mounted on a specific portion of the cartridge. For printing, the print head jets the ink to a sheet through nozzle holes by using pressure and heat.

One example of a conventional automatic sheet feeder has a guide which is movably secured to a knock-up plate, that is, a paper feed plate. The guide is movable to adjust to sheets of different widths and to prevent the sheet from being fed tilted with respect to the feeding direction. At the right side of the automatic sheet feeder body is rotatably mounted a setting lever for enabling a user, by rotating the lever, to set the uppermost one of the sheets piled up on the knock-up plate, that is, to bring the sheet into contact with feeding rollers. The knock-up plate is restrictively rotatable and has a compressing coil spring mounted on the lower side. The uppermost one of the sheets piled up on the knock-up plate is pressed into contact with the feeding rollers by the elastic force of the compression coil spring. Furthermore, the automatic sheet feeder has a sub-plate which is movable to assist the knock-up plate in supporting the sheet. For individual sheet feeding, the guide is rotated so that the sheets are individually fed in sequence.

At a lower portion of the knock-up plate, feeding rollers are mounted on a shaft at a specific distance from the knock-up plate, and these feeding rollers have rubber attached on the outer circumference to maximize frictional force with the sheet. Accordingly, when a driving force from a driver is provided, the shaft rotates the feeding rollers, and the sheet may be fed. In addition, friction pads are attached to the knock-up plate, facing the feeding rollers, to prevent feeding of more than one sheet at a time.

However, this conventional automatic sheet feeder has the disadvantages of complex structure and inherently large size, which makes it difficult to provide a compact sheet feeder. The complexity of the product may cause an increase in assembling time and a failure rate.

Other examples of sheet feeding devices of the contemporary art are seen, for example, in the following U.S. Patents: U.S. Pat. No. 2,204,715, to Wimmer, entitled Sheet Feeding Apparatus; U.S. Pat. No. 2,679,801, to Ford et al., entitled Driving Mechanism for Sheet-Feeding Devices in Duplicating and Like Machines; U.S. Pat. No. 3,599,971, to Morioka, entitled Device for Automatically Feeding Photosensitive Paper in a Copying Machine; U.S. Pat. No. 5,377,970, to Kikuchi, entitled Sheet Feeding Apparatus with Reduced Vibration Separator; U.S. Pat. No. 5,485,991, to Hirano et al., entitled Automatic Sheet Feeding Apparatus; and U.S. Pat. No. 5,527,026, entitled Auto Compensating Paper Feeder. The devices described in these patents are for ditto machines or copiers, however, and are generally designed for papers of a single width. None of these patents deals with an adjustable paper width guide of the kind usually found in ink jet printers for the purpose of allowing feeding of papers of different width without misfeeding involving tilting of the paper. Moreover, several of these patents disclose the use of spring-loaded knock-up or paper feed plates; the spring-loading arrangement adds to the size and complexity of the device.

Based on my observation of the art, I have discovered that what is needed is a sheet feeding device for an ink jet printer having a compact and simple design and reliable operation.

SUMMARY OF THE INVENTION

It is therefore an object of the present invention to provide an improved automatic sheet feeder for an ink jet printer.

It is another object of the invention to provide an automatic sheet feeder which is compact in size.

It is yet another object of the present invention to provide an automatic sheet feeder which has a simple structure.

It is still another object of the present invention to provide an automatic sheet feeder which does not require a restrictively rotatable paper feed plate.

It is a further object of the present invention to provide an automatic sheet feeder which has a simplified sheet width adjusting guide.

It is still a further object of present invention to provide an automatic sheet feeder which can be assembled quickly.

It is yet a further object present invention to provide an automatic sheet feeder which has a low failure rate.

It is a still yet further object of the present invention to provide an automatic sheet feeder of low manufacturing cost.

To achieve the above objects, there is provided an automatic sheet feeder for an inkjet printer including a sheet support fixed to a frame; a shaft rotatably secured to an upper portion of the sheet support, for rotating in a specified direction by a driving force from a driver; a sheet width adjusting guide movably mounted on one side of the shaft such that a front end is movable along the shaft and a rear end is slidable keeping in contact with the sheet support; and at least one feeding roller assembly, rotatably mounted on anther side of the shaft, including a feeding roller for feeding a sheet by a rotation force of the shaft. The shaft rotates in such a direction that the feeding roller contacts the sheet, and the feeding roller rotates in an opposite direction of the shaft.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
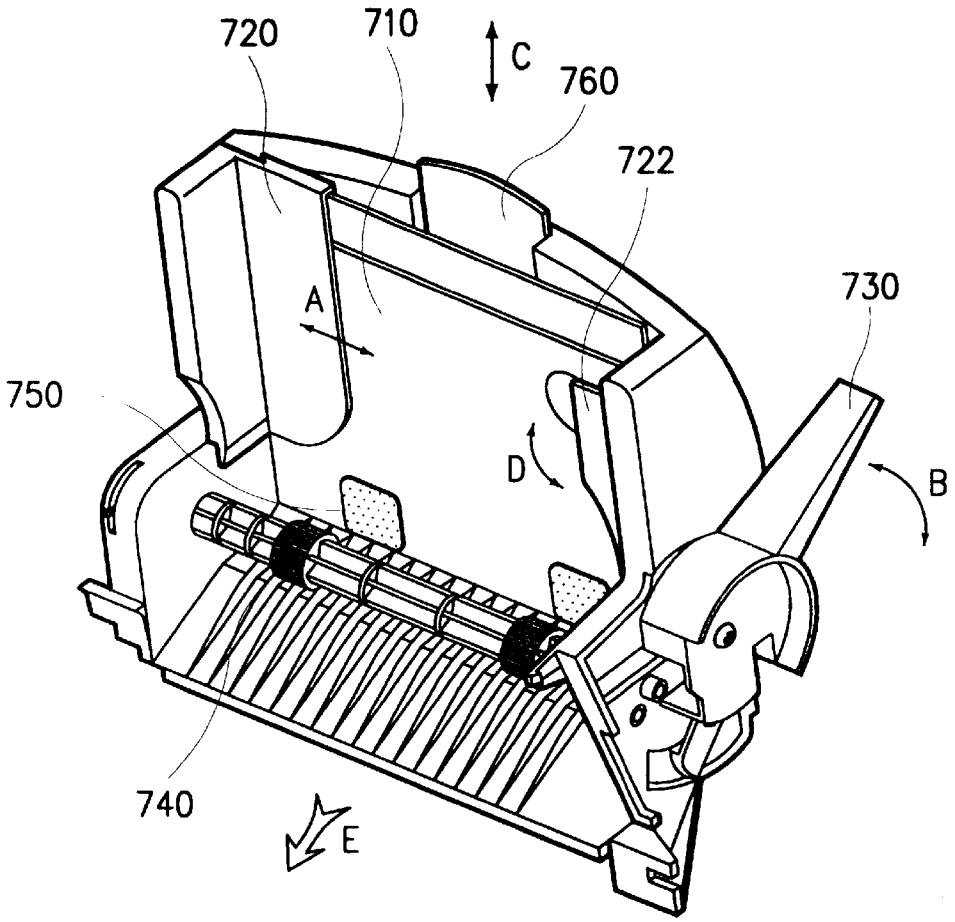
FIG. 1 (PRIOR ART)
FIG. 1 is a perspective view of a conventional automatic sheet feeder for (prior art) an ink jet printer.

FIG. 1 illustrates a conventional automatic sheet feeder for an ink jet printer. The conventional automatic sheet feeder has guide 720 which is movably secured to knock-up plate 710. Guide 720 is movable in an arrow direction A to adjust the width of sheets in different sizes and to prevent the sheet from being fed on the tilt.

At a right side of the automatic sheet feeder body, is rotatably mounted setting lever 730 for enabling a user to set an uppermost one of the sheets piled up on knock-up plate 710 by rotating it in arrow direction B. A sheet setting state refers to a state where the sheet is in contact with feeding rollers 740. Knock-up plate 710 is restrictively rotatable and has a undepicted compressing coil spring mounted on the lower side. The uppermost one of the sheets piled up on knock-up plate 710 comes in contact with feeding rollers 740 by an elastic force of the compression coil spring. Further, the automatic sheet feeder has sub-plate 760 which is movable in arrow direction C to assist knock-up plate 710 in supporting the sheet. For individual sheet feeding, guide 722 is rotated in arrow direction D so that the sheets are individually fed in sequence in arrow direction E.

At a lower portion of knock-up plate 710, feeding rollers 740 are mounted on a shaft at a specific distance and have rubber attached on the outer circumference thereof to maximize a friction force with the sheet. Accordingly, when the shaft provided with a driving force from a driver rotates feeding rollers 740, the sheet may be fed in arrow direction E. In addition, friction pads 750 are attached to knock-up plate 710, facing feeding rollers 740, to prevent feeding of plural sheets.

As noted above, the conventional automatic sheet feeder has the disadvantages of complex structure and large size, which makes it difficult to provide a compact sheet feeder. The complexity of the product may cause an increase in assembling time and in failure rate of the device.

A preferred embodiment of the present invention will be described hereinbelow with reference to the accompanying drawings. In the following description, well known functions or constructions are not described in detail since they would obscure the invention in unnecessary detail.

Figure 2:
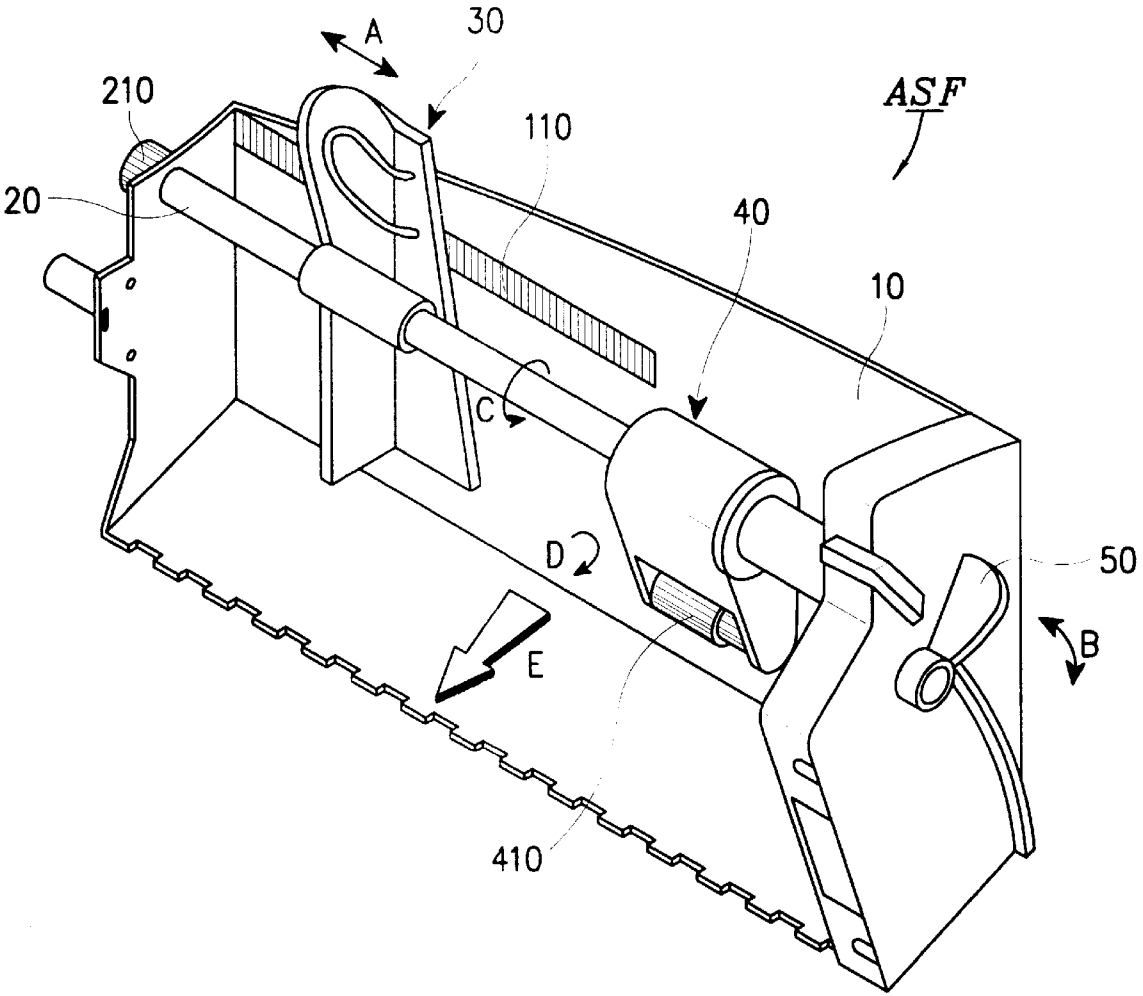
FIG. 2 is a perspective view of an automatic sheet feeder for an inkjet printer according to an embodiment of the present invention.

FIG. 2 illustrates an automatic sheet feeder for an ink jet printer according to an embodiment of the present invention. Automatic sheet feeder 100 is designed to be attachable to the rear of an ink jet printer body. Though not illustrated, the individual sheet fed by the automatic sheet feeder passes, for printing, through a carriage on which the ink cartridge is mounted, and is then discharged to a discharge tray through star wheels and sheet-discharge rollers. For printing, the ink jet printer jets ink to the sheet fed by the automatic sheet feeder through the nozzle holes of the head mounted on the bottom surface of the ink cartridge.

The automatic sheet feeder includes sheet support 10 and sheet width adjusting guide 30 for preventing the sheet on sheet support 10 from being fed tilted to the direction of feeding. Sheet support 10 includes back 60 and sides 70. Sheet width adjusting guide 30 is movably mounted on shaft 20. Further, sheet support 10 includes setting lever 50, rotatably fixed to one side of sheet support 10, for setting the sheets piled up on sheet support 10, and undepicted fingers, interlocked with setting lever 50, for feeding the sheets one by one. In this structure, sheet support 10 lacks flexibility, that is, is rigidly mounted. That is, although the analogous element to sheet support 10 in the conventional sheet feeder, i.e., knock-up plate 710, is restrictively rotatable to keep in contact with the sheet, sheet support 10 of the invention is independent of other elements. In the present invention, this contact is achieved since the automatic sheet feeder is designed such that when the sheet feeder is installed in the ink jet printer body, sheet support 10 is slightly slanted.

Shaft 20 is rotatably secured to an upper portion of one side 70 of sheet support 10, at a right angle to a sheet feeding direction. At an end of shaft 20 is fixed gear 210 for transferring the driving force from a driver to shaft 20. That is, the driver rotates shaft 20 by way of gear 210.

Sheet width adjusting guide 30 is mounted on shaft 20 such that a front end of sheet width adjusting guide 30 is movable along shaft 20 and a rear end of sheet width adjusting guide 30 is slidably keeping in contact with back 60 of sheet support 10. Therefore, guide 30 can adjust to the width of the sheet by moving left and right along shaft 20. Further, there are protrusions (or saw teeth) 110 on a surface of back 60 of sheet support 10, to fix guide 30 at the appropriate location according to the width of the sheet.

Furthermore, at another end of shaft 20, is mounted feeding roller assembly 40 for applying a feeding force to the piled sheets. Feeding roller assembly 40 is provided with a driving force from shaft 20 and transfers the driving force to feeding roller 410 disposed at an end of feeding roller assembly 40 by using gear 210. Feeding roller 410 feeds the sheet by frictional force with the set sheet.

In operation, a user piles up a plurality of sheets on sheet support 10 and moves guide 30 along shaft 20 in arrow direction A to fix the sheets onto sheet support 10. Next, the user rotates sheet setting lever 50 in arrow direction B to set the sheets. When the user pushes an operation button to actuate the driver, shaft 20 rotates in arrow direction C and feeding roller 410 rotates in arrow direction D, thereby feeding the sheet in arrow direction E by the friction force with the sheet.

In the embodiment illustrated, feeding roller assembly 40 is structured such that feeding roller 410 rotates in the opposite direction to the rotation of shaft 20. Specifically, feeding roller assembly 40 revolves around shaft 20, so that a rotation force of shaft 20 in arrow direction C may force feeding roller 410 to the sheet. Therefore, feeding roller 410 can keep in contact with the sheet. Further, feeding roller 410 rotates in arrow direction D to feed the sheet in the direction of arrow E, toward the carriage in the printer.

In addition, when the automatic sheet feeder is installed in the ink jet printer body, sheet support 10 is slanted and thus feeding roller 410 contacts the uppermost sheet on the sheet support 10 by self-weight, that is, by gravity. Thus, feeding roller 410 contacts the uppermost sheet by both the rotation force of shaft 20 and the self-weight of feeding roller 410. Accordingly, even while shaft 20 does not rotate, feeding roller 410 may keep in contact with the sheet. When shaft 20 rotates in arrow direction C, feeding roller 410 will contact the sheet more tightly.

Although the invention has been described with reference to an automatic sheet feeder having one feeding roller assembly, it can be appreciated that the automatic sheet feeder may have two or more feeding roller assemblies.

As described above, the novel automatic sheet feeder is small and simple in structure, which is advantageous to miniaturization. While the invention has been shown and described with reference to a certain preferred embodiment thereof, it will be understood by those skilled in the art that various changes in form and details maybe made therein without departing from the spirit and scope of the invention as defined by the appended claims.

What is claimed is:

1. An automatic sheet feeder for an ink jet printer, comprising:

a sheet support for supporting a sheet of paper to be fed, said sheet support being attachable to the ink jet printer and being slightly slanted from the vertical when attached and said sheet support having two sides and a back;

a shaft, rotatably mounted to one of said sides of said sheet support, said shaft having an end;

a driver, connected to said shaft, for driving the rotation of said shaft;

a sheet width adjusting guide having a front end and a rear end, and being movable along said shaft, said front end being perforated by said shaft and said rear end contacting said back of said sheet support, such that said sheet width adjusting guide remains in contact with said back of said sheet support when said shaft rotates; and a feeding roller assembly mounted on said shaft, when said feeding roller assembly causes said feeding roller to always contact said sheet support due to its own weight, comprising:

a feeding roller mechanically linked to said shaft so as to rotate when said shaft rotates.

2. The automatic sheet feeder of claim 1, further comprising:

said feeding roller being mechanically linked to said shaft such that said feeding roller rotates in the opposite direction from the direction of rotation of said shaft.

3. The automatic sheet feeder of claim 1, further comprising:

said feeding roller assembly being mounted on said end of said shaft.

* * * * *